US012773614B2

(12) United States Patent
Titus et al.

(10) Patent No.: US 12,773,614 B2
(45) Date of Patent: Oct. 27, 2026

(54) AUTOMATIC BALL MACHINE APPARATUS UTILIZING SHOT IDENTIFICATION AND ANALYSIS

(71) Applicant: Volley LLC, Lancaster, PA (US)

(72) Inventors: Stephen Titus, Herndon, VA (US); Lukasz Masiukiewicz, York, PA (US); Christopher Louis Decker, Papillion, NE (US); John Weinlader, Wilmette, IL (US); Daniel Weinlader, Lititiz, PA (US)

(73) Assignee: Volley LLC, Lancaster, PA (US)

( * ) Notice: Subject to any disclaimer, the term of this patent is extended or adjusted under 35 U.S.C. 154(b) by 106 days.

(21) Appl. No.: 18/512,451

(22) Filed: Nov. 17, 2023

(65) Prior Publication Data

US 2025/0161779 A1 May 22, 2025

(51) Int. Cl.
*A63B 69/38* (2006.01)
*A63B 24/00* (2006.01)
(Continued)

(52) U.S. Cl.
CPC ..... *A63B 69/406* (2013.01); *A63B 24/0062* (2013.01); *A63B 71/0622* (2013.01);
(Continued)

(58) Field of Classification Search
CPC ..... A63B 71/0605; A63B 71/0622; A63B 69/406; A63B 69/40; A63B 2071/0627;
(Continued)

(56) References Cited

U.S. PATENT DOCUMENTS 4,269,163 A * 5/1981 Feith ..... A63B 69/40 124/77
5,125,653 A * 6/1992 Kovacs ..... A63B 69/406 124/78
(Continued)

FOREIGN PATENT DOCUMENTS

CN 110538443 A 12/2019
KR 102265914 6/2021
(Continued)

OTHER PUBLICATIONS

POP Tennis How to Play and Court and Equipment Guide, International POP Tennis Association, Inc., https://www.poptennis.com, accessed Sep. 2022.
(Continued)

*Primary Examiner* — John E Simms, Jr.
(74) *Attorney, Agent, or Firm* — Muir Patent Law, PLLC

(57) ABSTRACT

A ball machine comprising an imaging system attached to the ball machine and configured to capture image data of a court, a ball launching system configured to launch a ball to a user and a processor. The processor configured to initiate a workout routine that includes launching, using the ball launching system, a sequence of balls to a user, select a shot type of a first ball to launch in the sequence, control settings of the ball launching system to launch the first ball based on the selected shot type to the user, determine a shot type returned by the user in response to the launched first ball, select a shot type of a second ball to launch in the sequence, and control settings of the ball launching system to adjust one or more parameters of the second ball based on the determined shot type returned by the user.

32 Claims, 8 Drawing Sheets

(51) Int. Cl.
*A63B 69/40* (2006.01)
*A63B 71/06* (2006.01)

(52) U.S. Cl.
CPC . *A63B 2024/0028* (2013.01); *A63B 2069/402* (2013.01); *A63B 2071/0627* (2013.01); *A63B 2214/00* (2020.08); *A63B 2220/05* (2013.01); *A63B 2220/807* (2013.01); *A63B 2225/74* (2020.08)

(58) Field of Classification Search
CPC ..... A63B 24/0062; A63B 2024/0034; A63B 2024/0028; A63B 2220/30; A63B 2220/05; A63B 2225/807; A63B 2225/805; A63B 2225/806; A63B 2225/74; A63B 2225/093; A63B 2225/50; A63B 2214/00; A63B 69/38; A63B 2069/402; A01K 15/02; A01K 15/021; A01K 15/025
See application file for complete search history.

(56) References Cited

U.S. PATENT DOCUMENTS

| | | | | |
|---|---|---|---|---|
| 5,816,953 | A | 10/1998 | Cleveland | |
| 6,539,931 | B2 | 4/2003 | Trajkovic et al. | |
| 7,610,909 | B2 * | 11/2009 | Greene, Jr. | A63B 69/406 124/78 |
| 7,691,012 | B2 * | 4/2010 | Cucjen | A63B 69/406 124/78 |
| 8,419,560 | B2 | 4/2013 | Amini | |
| 9,233,294 | B1 | 1/2016 | Coyle | |
| 10,695,644 | B2 | 6/2020 | Khazanov et al. | |
| 11,033,780 | B2 | 6/2021 | New et al. | |
| 11,367,364 | B2 | 6/2022 | May | |
| 11,657,906 | B2 | 5/2023 | Lewis et al. | |
| 2001/0018912 | A1 * | 9/2001 | Battersby | A63B 69/406 124/78 |
| 2013/0018493 | A1 * | 1/2013 | Amini | G09B 19/0038 124/80 |
| 2013/0104869 | A1 * | 5/2013 | Lewis | G16H 20/30 124/78 |
| 2013/0104870 | A1 * | 5/2013 | Rizzo | A63B 69/38 124/78 |
| 2013/0130845 | A1 * | 5/2013 | Marty | G06V 40/23 473/459 |
| 2014/0121043 | A1 * | 5/2014 | Blanning | A63B 69/40 473/459 |
| 2015/0165300 | A1 | 6/2015 | Vaught et al. | |
| 2016/0310817 | A1 * | 10/2016 | Yeager | A63B 69/406 |
| 2018/0140917 | A1 * | 5/2018 | Song | A63B 24/0006 |
| 2019/0126120 | A1 | 5/2019 | Paredes et al. | |
| 2019/0240558 | A1 * | 8/2019 | Khazanov | G06T 7/277 |
| 2020/0197782 | A1 * | 6/2020 | Abdelmoneum | A63B 71/0622 |
| 2020/0398139 | A1 * | 12/2020 | Harley | A63B 69/38 |
| 2021/0031081 | A1 * | 2/2021 | Lewis | A63B 24/0075 |
| 2021/0128989 | A1 | 5/2021 | Legg et al. | |
| 2021/0354021 | A1 * | 11/2021 | Hannallah | A63B 69/406 |
| 2021/0379446 | A1 * | 12/2021 | Weinlader | A63B 69/40 |
| 2022/0198368 | A1 | 6/2022 | May | |
| 2022/0233942 | A1 * | 7/2022 | Ferrabee | G06T 7/75 |
| 2023/0372803 | A1 * | 11/2023 | Kweon | G06V 20/46 |
| 2024/0152759 | A1 * | 5/2024 | Rapp | A63B 24/00 |

FOREIGN PATENT DOCUMENTS

| | | | |
|---|---|---|---|
| KR | 102265914 | B1 | 6/2021 |
| WO | 2022038587 | A1 | 2/2022 |
| WO | 2022050792 | A1 | 3/2022 |

OTHER PUBLICATIONS

2022 Official International Federation of Pickleball Rulebook, International Federation of Pickleball, Revised 2022.
Regulations of the Padel Game, International Padel Federation, May 28, 2021.
2022 International Tennis Federation Rules of Tennis, International Tennis Federation, 2021.
Official Rules of Platform Tennis, American Platform Tennis Association, www.platformtennis.org/about_us/Rules_of_Platform_Tennis.htm, accessed Sep. 2022.

* cited by examiner

AUTOMATIC BALL MACHINE APPARATUS UTILIZING SHOT IDENTIFICATION AND ANALYSIS

BACKGROUND

A ball machine that projects balls at a player may be used to develop player skills, provide a fitness workout, or provide recreational activity. The ball machine may be utilized in racket sports, such as tennis, pickleball, POP tennis, padel, platform tennis, etc. Typically, these ball machines have speed control knobs that allow an operator to adjust various motors and actuators to "dial-in" a ball launch (i.e., shot) that the player wants to practice. This "dial-in" practice is time consuming and cumbersome.

Conventional ball machines are unable to identify and analyze a type of shot hit by a user during a training routine (workout routine) and dynamically adjust settings of the ball machine during the training routine in response to the identification and analysis performed.

SUMMARY

A ball machine comprising an imaging system attached to the ball machine and configured to capture image data of a court; a ball launching system configured to launch a ball to a user; and a processor configured to execute a process that includes initiating a workout routine that includes launching, using the ball launching system, a sequence of balls to a user, selecting a shot type of a first ball to launch in the sequence, controlling settings of the ball launching system to launch the first ball based on the selected shot type to the user, determining a shot type returned by the user in response to the launched first ball, selecting a shot type of a second ball to launch in the sequence, and controlling settings of the ball launching system to adjust one or more parameters of the second ball based on the determined shot type returned by the user.

A method of operating a ball machine, the method comprising initiating a workout routine that includes launching, using a ball launching system, a sequence of balls to a user positioned on a court, selecting a shot type of a first ball to launch in the sequence, controlling settings of the ball launching system to launch the first ball based on the selected shot type to the user, determining a shot type returned by the user in response to the launched first ball, selecting a shot type of a second ball to launch in the sequence, and controlling settings of the ball launching system to adjust one or more parameters of the second ball based on the determined shot type returned by the user.

BRIEF DESCRIPTION OF THE DRAWINGS

The above and other objects, features, and advantages of the inventive concept will become more apparent to those skilled in the art upon consideration of the following detailed description with reference to the accompanying drawings.

DETAILED DESCRIPTION OF EXEMPLARY EMBODIMENTS

Figure 1:
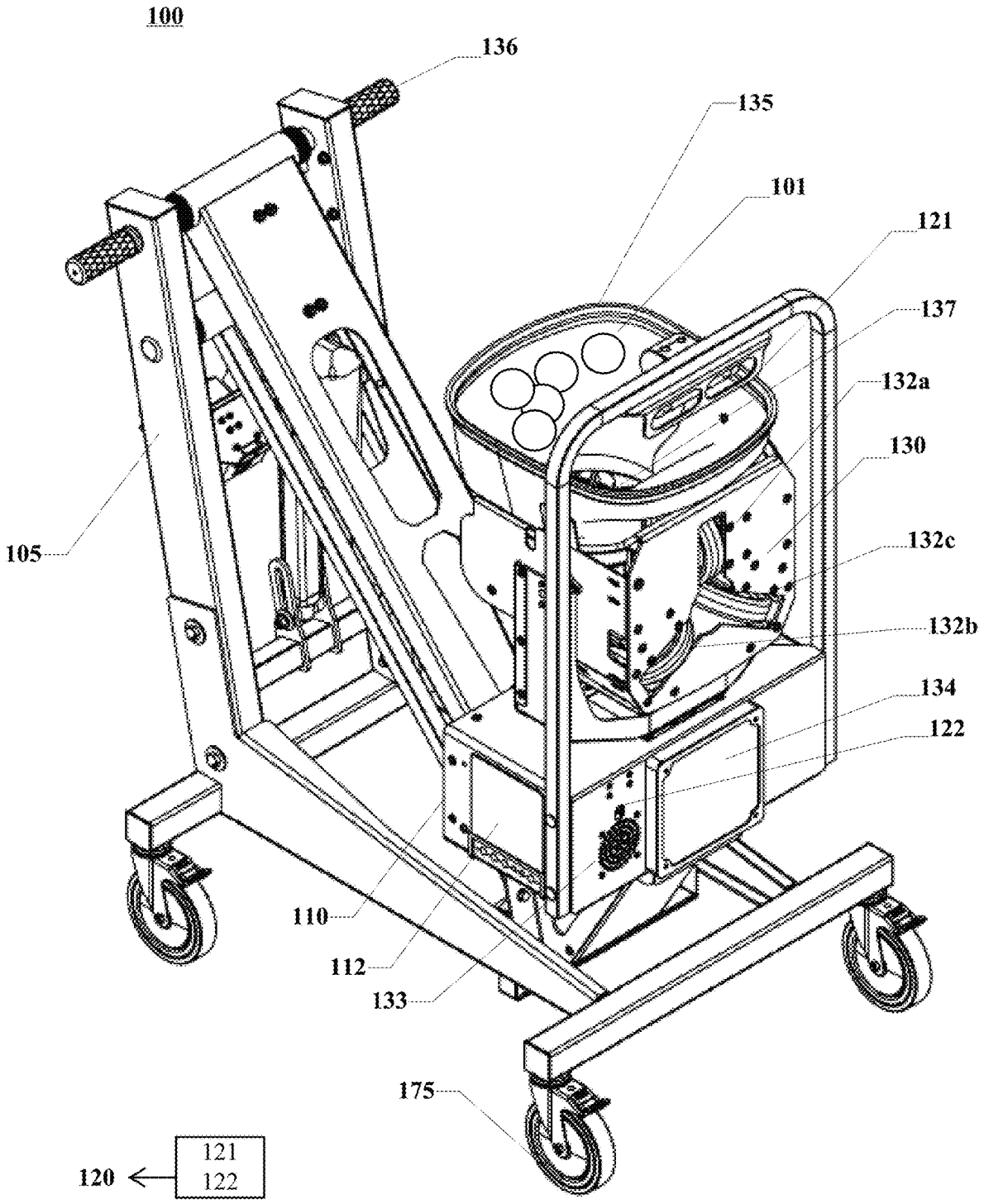
FIG. 1 illustrates an isometric front view of an automatic ball machine in a lowered position according to example embodiments.
Figure 2:
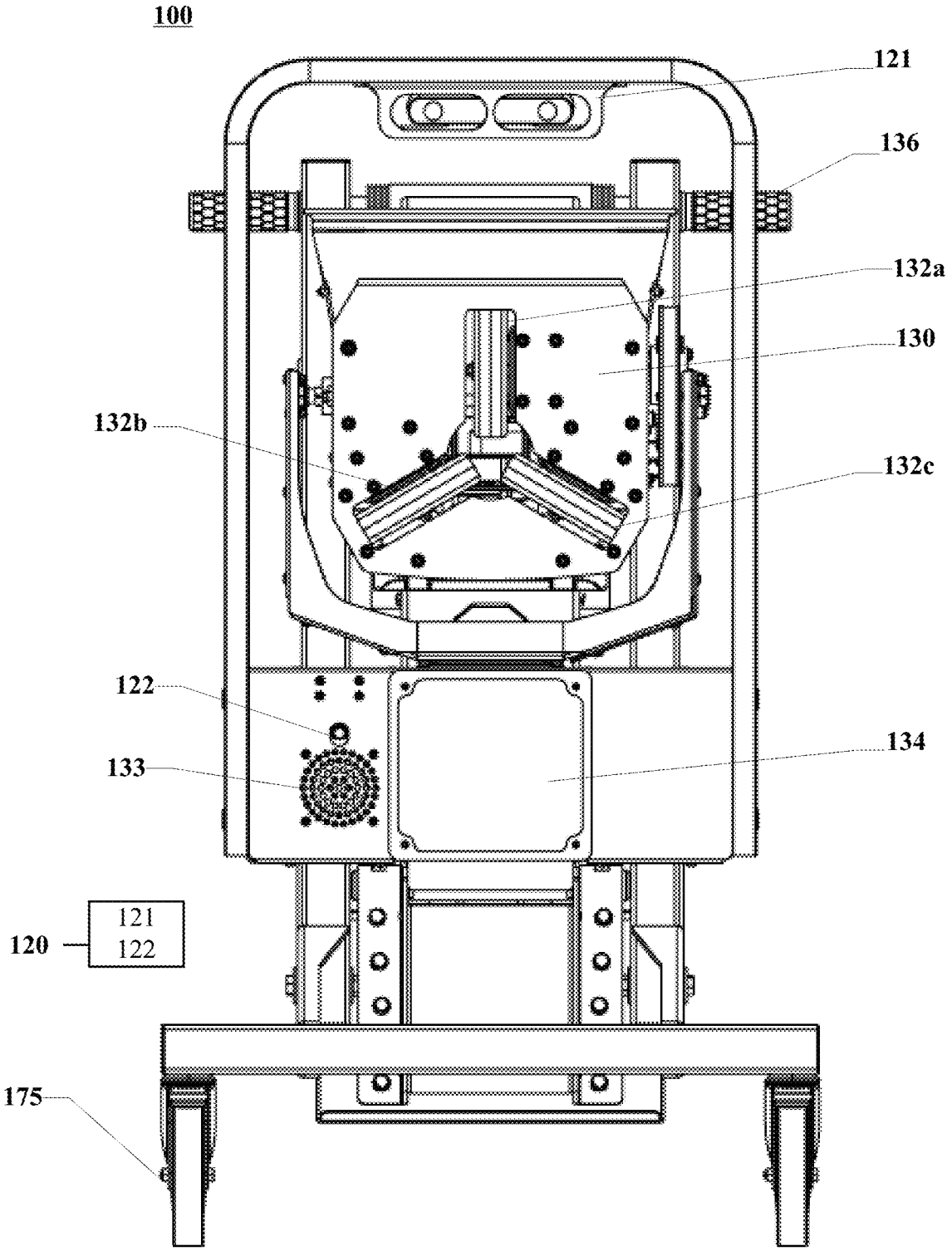
FIG. 2 illustrates a front view of the automatic ball machine in a lowered position according to example embodiments.
Figure 3:
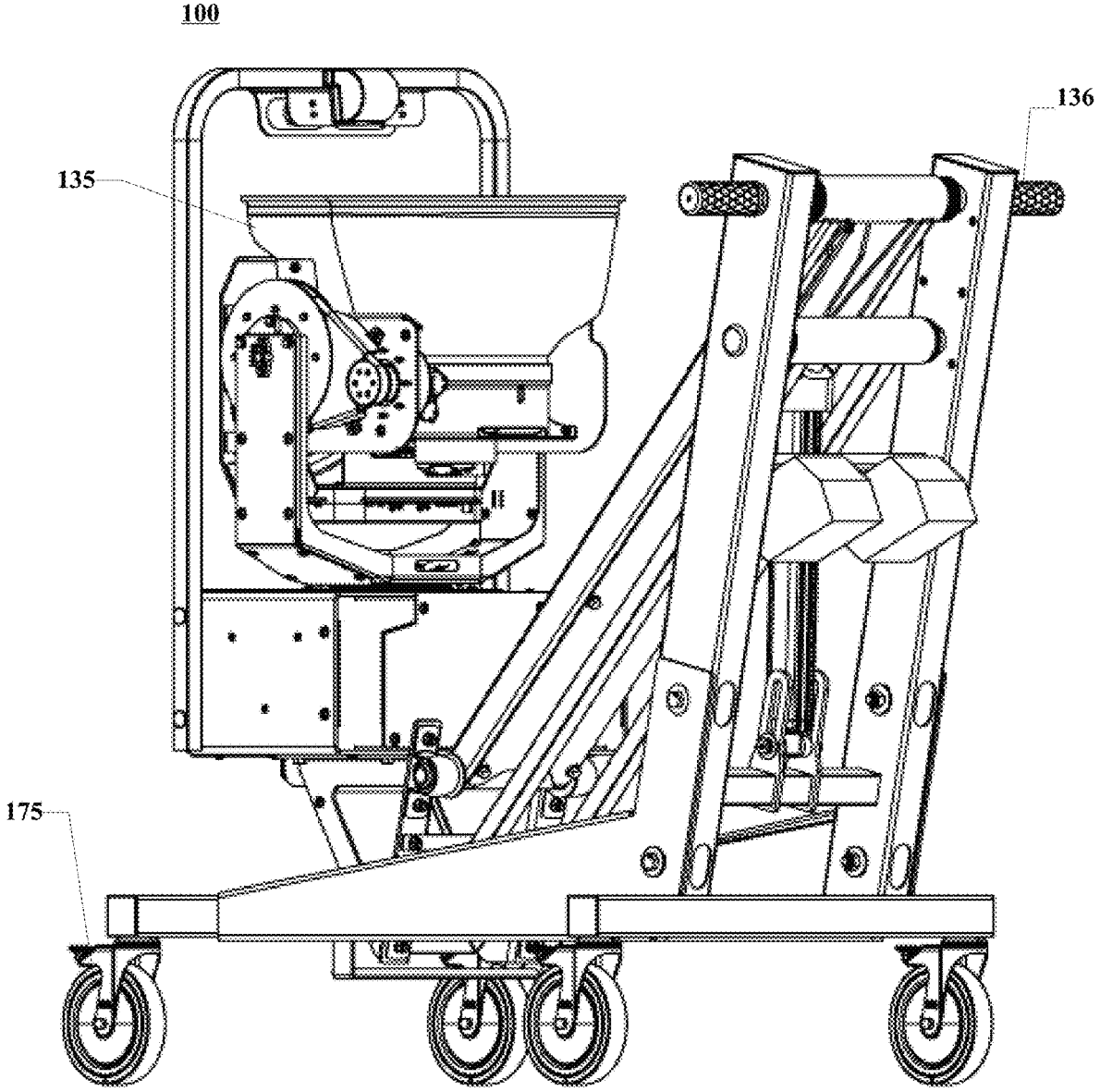
FIG. 3 illustrates an isometric rear view of the automatic ball machine in a lowered position according to example embodiments.
Figure 4:
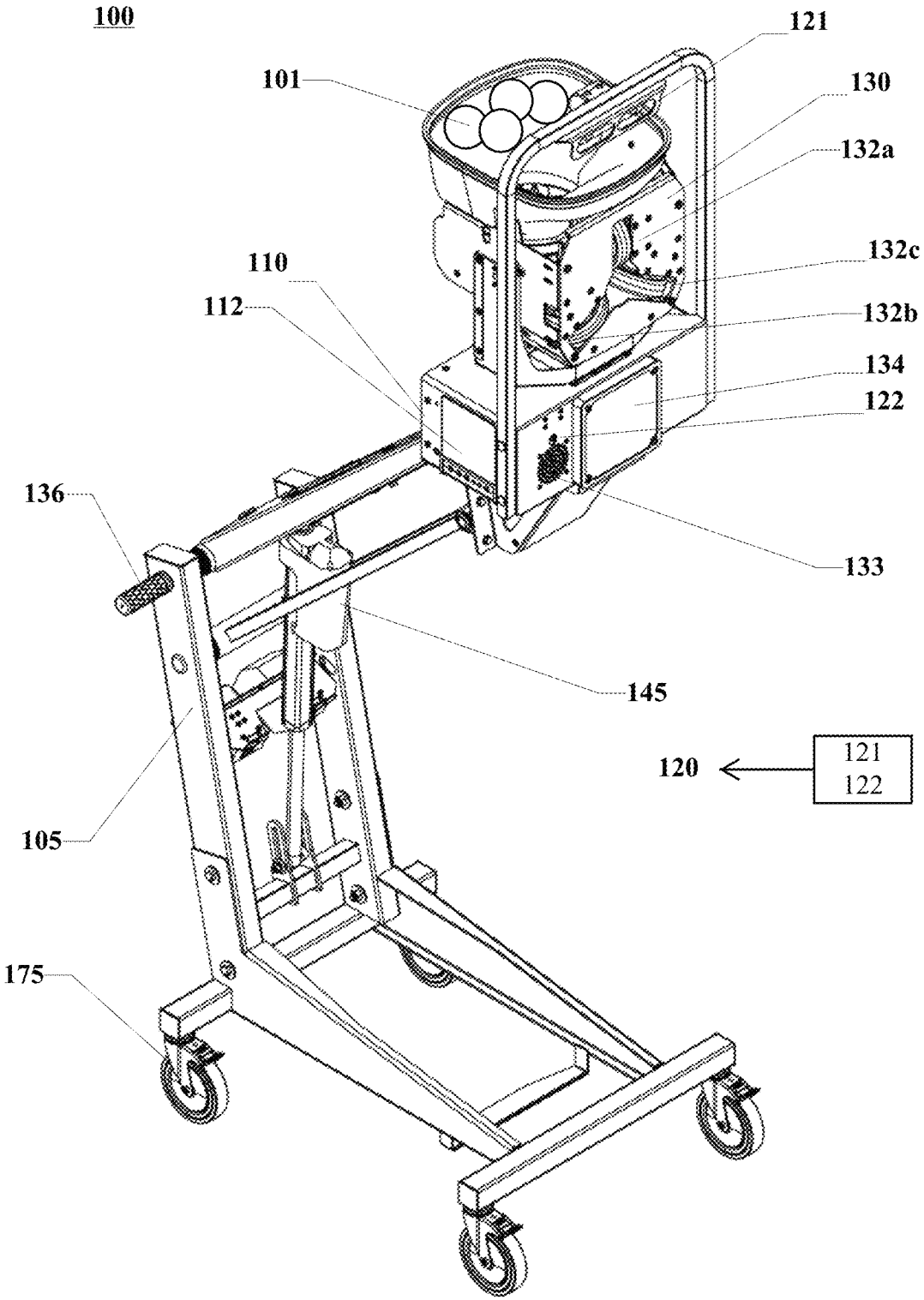
FIG. 4 illustrates an isometric front view of the automatic ball machine in a raised position according to example embodiments.
Figure 5:
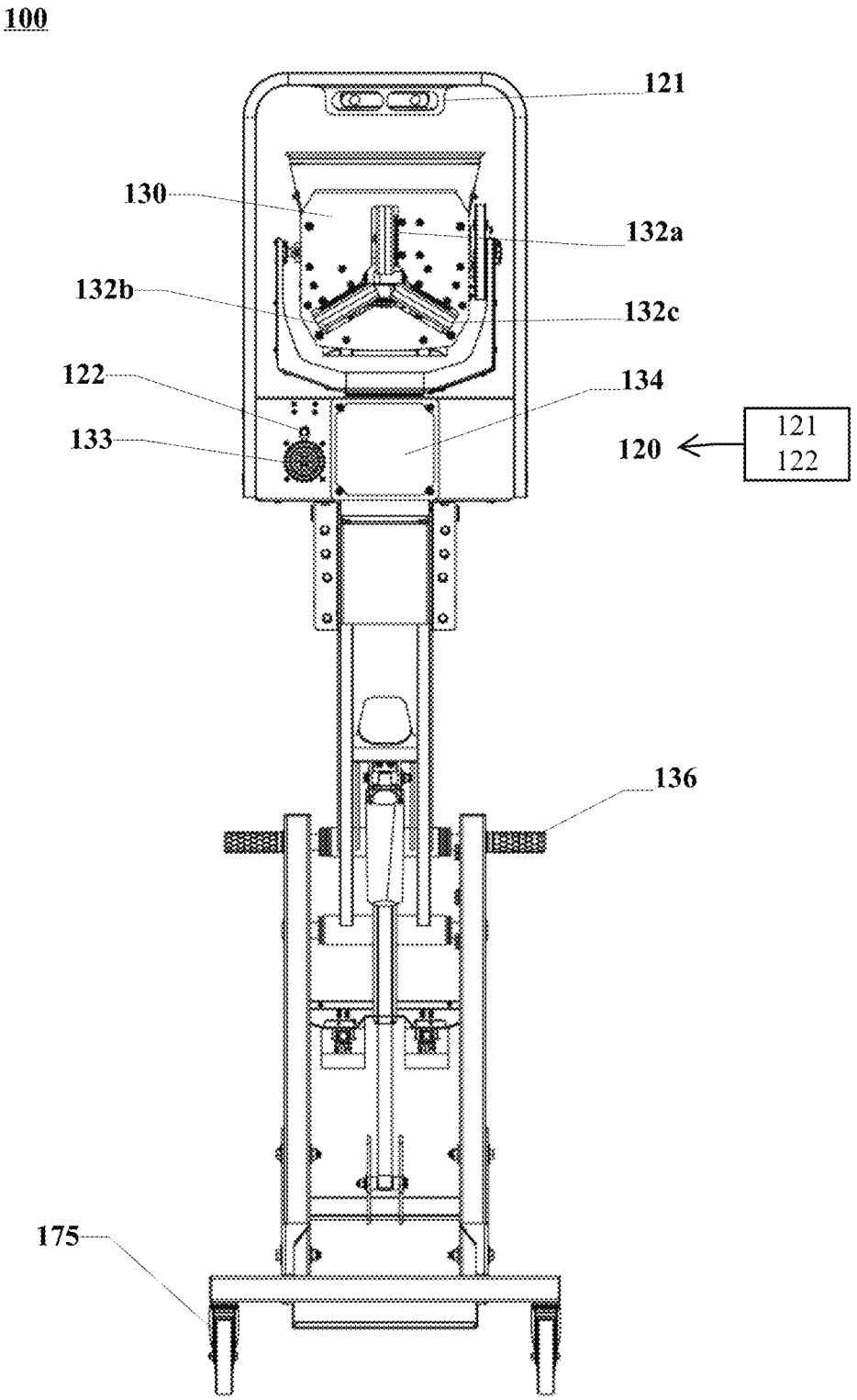
FIG. 5 illustrates a front view of the automatic ball machine in a raised position according to example embodiments.
Figure 6:
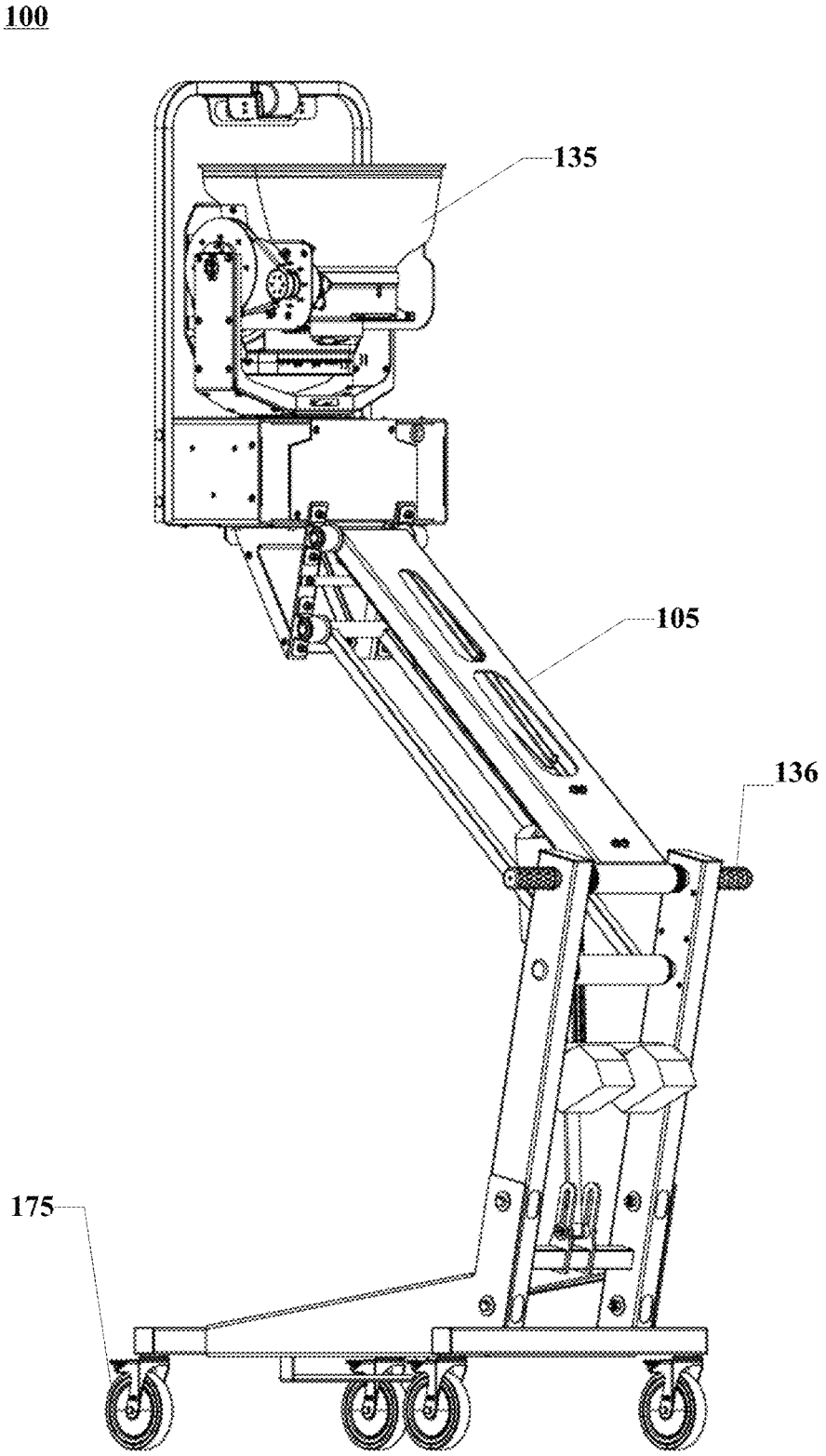
FIG. 6 illustrates an isometric rear view of the automatic ball machine in a raised position according to example embodiments.

Various aspects of the inventive concept will be described more fully hereinafter with reference to the accompanying drawings.

FIGS. 1-6 illustrate varying orientation views of an automatic ball machine 100 according to example embodiments. Referring to FIGS. 1-6, the automatic ball machine 100 may include a frame 105 onto which various components are coupled, such as a controller 110, a first camera 121, and a second camera 122 mounted inside controller 110. Although the entirety of the second camera 122 is not illustrated in the drawings, the optical input of the second camera 122 is illustrated in the drawings above speaker 133. The automatic ball machine 100 may include a ball launching system 130 to launch (i.e., project) balls 101, a hopper 135 to store a quantity of the balls 101 prior to launch, a mobility system 175 to move the automatic ball machine 100, and handles 136 configured to maneuver and adjust the automatic ball machine 100. Components of the automatic ball machine 100 may be physically connected to each other through the frame 105 of the automatic ball machine 100. For example, the first camera 121 and the second camera 122 (collectively referred to herein as "imaging system 120") are physically connected to the ball launching system 130 through the frame 105. The height position, in the vertical direction, of the automatic ball machine 100 is shown in a lowered position in FIGS. 1-3 and in a raised position in FIGS. 4-6. The height position of the automatic ball machine 100 may be adjusted using the height actuator 145, for example. The height position of the automatic ball machine 100 may be adjusted and set anywhere in-between the illustrated lowered position and the illustrated raised position depending, for example, upon the trajectory needed to launch the balls 101 by the ball launching system 130. The height position of the automatic ball machine 100 may also range from the lowered position to the raised position during a localization operation for automatically determining the location of the automatic ball machine 100 on the court, detailed in application Ser. No. 18/097,345 ("the '345 application") filed on Jan. 16, 2023, the entire content of which is herein incorporated by reference. The automatic ball machine 100 may further include a ball feeder 137 to control, via the controller 110, feeding of balls 101 to the ball launching system 130, such as from the hopper 135.

According to example embodiments, the imaging system 120 may be disposed on the automatic ball machine 100 to capture digital images (e.g., video frames or frames) in a direction in which balls 101 are launched from the automatic ball machine 100. The first camera 121 and the second camera 122 may be positioned to capture digital images at two different vantage points. Information may be extracted from the digital images through computer vision. In an example embodiment, the first camera 121 of the imaging system 120 may be a stereo camera. In another example embodiment, first camera 121 and second camera 122 of the imaging system 120 may be replaced with a Time-Of-Flight (TOF) camera to detect a depth of field.

In a further example, the imaging system 120 may include cameras in addition to cameras 121 and 122 to improve the data that is being received by the controller 110. For example, the imaging system 120 may include a plurality of cameras configured to detect objects to the left of the launch direction, to the right of the launch direction, and away from the launch direction, respectively. The plurality of cameras may increase an effective field-of-view of the imaging system 120. The imaging system 120 may be used to perform person detection, person identification, person tracking, and pose estimation procedures as described in detail in application Ser. No. 18/198,167 ("the '167 application") filed on May 16, 2023, the entire content of which is herein incorporated by reference.

The ball launching system 130 may include a plurality of spinner wheels, coupled to a plurality of motors, to launch the balls 101. For example, the ball launching system 130 may include first, second, and third spinner wheels 132*a*, 132*b*, 132*c*, coupled to first, second, and third spinner motors, respectively. As illustrated for example in FIG. 2, the spinner wheel 132*a* is shown as being disposed at approximately (+/−5 degrees) of the 12 o'clock position, with the spinner wheel 132*c* being disposed at approximately (+/−5 degrees) of the 4 o'clock position, and the spinner wheel 132*b*, being disposed at approximately (+/−5 degrees) of the 8 o'clock position.

In addition to performing functions related to shot identification and shot tracking procedures described in further detail below, the first camera 121 may also act as an environment sensor to detect objects in a direction that balls 101 are being launched from the automatic ball machine 100. For example, the automatic ball machine 100 may use the first camera 121 as an environment sensor to monitor, via the controller 110, an area in a direction that the ball 101 is being launched, and in at least one configuration around the automatic ball machine 100 to ensure no person or unintended objects are struck by the balls 101 being launched by the automatic ball machine 100, or harmed by any automated mechanical movement of the automatic ball machine 100. The automatic ball machine 100 may establish a keep-out region, that if violated, will result in the automatic ball machine 100 stopping launching of the balls 101 and/or mechanical movement, such as the ball launching system 130, and in at least one configuration issuing a warning to a player. The warning may comprise a visual cue via, for example, a display device 134 or a lighting system (not illustrated). The warning may also comprise an audio cue via, for example, a speaker 133. The display device 134 may be a flat-panel display, such as an LCD display, an LED display, an OLED display, a QLED display, or the like.

The automatic ball machine 100 may adjust a distance the keep-out region extends from the automatic ball machine 100 based on a court location of the automatic ball machine 100. To vary the coverage area around the automatic ball machine 100, additional environment sensors may be included. For example, the automatic ball machine 100 may include an additional environment sensor, such as a Light Detection and Ranging (LiDAR) sensor or similar, to detect objects outside a field-of-view of the imaging system 120, and/or to provide backup or additional data for the controller 110. A full 360-degree coverage around the automatic ball machine 100 may be implemented via additional environment sensors, for example, LiDAR sensors. In other configurations, additional environment sensors may further include, for example, barometric sensors, temperature sensors, humidity sensors, anemometer sensors, and the like.

As used herein, the term "court" refers to: a flat playing surface including a flat rectangular playing area defined by line markings on the flat playing surface; structures that are a part of the playing area; and enclosures surrounding the playing surface. The line markings may delineate regions within the playing area (e.g., a service box) and boundaries of the playing area (e.g., a side line and a base line) on the playing surface. The playing surface may extend beyond the boundaries of the playing area. Structures that are a part of the playing area may include a net, a cord or cable suspending the net, and net posts to which the net, suspended by the cord or cable, is attached. In racket sports such as platform tennis and padel, wherein the official rules and regulation of the games provide for a ball to be played off (i.e., come into contact with) an enclosure surrounding the playing surface during regulation game play, the enclosures may be a part of the "court" as used herein. With respect to platform tennis, the enclosure may consist of a screen. With respect to padel, the enclosure may consist of walls formed of a transparent or opaque material and walls composed of metal fencing.

Figure 7:
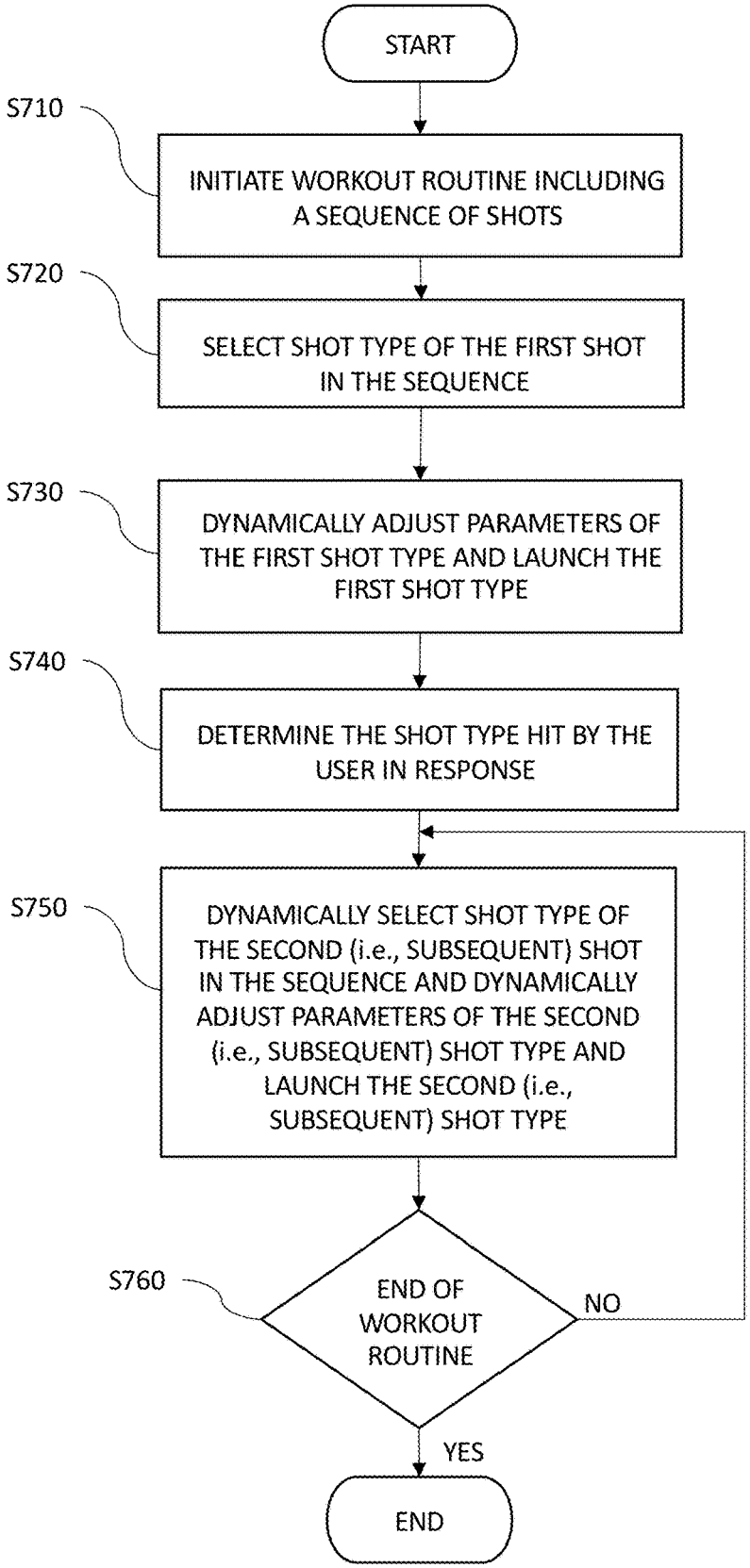
FIG. 7 illustrates a flowchart of a shot identification and analysis procedures according to example embodiments.

FIG. 7 illustrates a flowchart setting forth exemplary steps of a shot identification and shot analysis procedures with respect to a person on a court (i.e., user, player, human).

Referring to FIG. 7, an initial step of a player shot identification and analysis procedures performed by the automatic ball machine 100 may include the initiation of a workout routine by a user (S710). For example, through a user interface provided on the automatic ball machine 100 or provided on a remote user device (e.g., a mobile phone, smart watch, personal computer, tablet, etc.) connected (e.g., wirelessly or wired) to the automatic ball machine 100, the user may initiate the workout routine by selecting from a list of predetermined workout routines stored locally on the automatic ball machine 100 or stored remotely and accessible by the automatic ball machine 100 via a wired or wireless connection.

Each of the predetermined workout routines may include a sequence of shots that are launched by the automatic ball machine 100. The length (e.g., duration) of the predetermined workout routines may be defined, for example, by limiting the number of shots (e.g., 30 shots) in the sequence, by limiting the workout routine to a predetermined time interval (e.g., 15 minutes), or by limiting the workout routine based on user associated performance metrics. The types of shots (i.e., shot types) included in the sequence of shots of a workout routine may be the same or may vary during the workout routine. As discussed in further detail below, a variety of workout routines that are distinguished, for example, by their respective sequence of shots and/or duration, may be executed by the automatic ball machine 100.

Shot types included in the sequence of shots may comprise, for example, a serve, drive (i.e., a ground stroke, volley, or half-volley), lob, drop shot, etc. As further detailed below, parameters that define a shot type may include those corresponding to one or more of when a shot is hit, how the shot is hit, and where the shot is hit. The shot type serve, for example, is a shot that is launched to start a point and lands cross-court (i.e., from a first service box to the diagonal service box on the opposite side of the net). The shot type drive, for example, is a shot that is launched such that it has a low net clearance (e.g., 3 feet or less). The net clearance may be defined as the height measured from the top of the net to the bottom of the ball when the ball crosses over the net. The shot type drive may be further defined as a shot that also has a low launch angle (e.g., 25 degrees or less). The shot type lob, for example, is a shot that is launched high in the air (e.g., 12 feet or more) and lands over the opposing player within the playing area. The shot type lob may be further defined as a shot that also has a high launch angle (e.g., greater than 25 degrees). The shot type drop shot, for example, is a shot that is launched such that it lands across and in close proximity to the net (e.g., 7 feet or less). The shot type drop shot may be further defined as a shot that also has a high launch angle (e.g., greater than 25 degrees). Additional parameters, such as velocity, magnitude of spin, orientation of spin, height, launch angle, location (e.g., landing point on the court), slice, height, trajectory, etc. may be used to further define each of the above noted shot types. As described above, the parameters of a particular shot type may be set within a range of values with respect to each parameter. For example, with respect to the shot type drive, the parameter of height may be set such that net clearance is within a range of 3 feet or less, and the parameter of launch angle may be set within a range of 25 degrees or less.

As a non-limiting example, a first workout routine may focus on the service return of a user. Accordingly, the shot sequence in the first workout routine may include only the shot type serve. A second workout routine may focus on the drive return (e.g., forehand drive return, backhand drive return) of a user. Accordingly, the shot sequence in the second workout routine may include only the shot type drive. A third workout routine may focus on the lob return of a user. Accordingly, the shot sequence in the third workout routine may include only the shot type lob. A fourth workout routine may focus on the drop shot return of a user. Accordingly, the shot sequence in the fourth workout routine may include only the shot type drop shot. A fifth workout routine may focus on the volley shot return of a user. Accordingly, the shot sequence in the fourth workout routine may include only the shot type volley. In the first, second, third, fourth, and fifth workout routines, although the respective shot sequences include only the same shot type (i.e., serve, drive, lob, drop shot, volley), the automatic ball machine 100 may adjust parameters of one or more individual shots in the respective shot sequences based on a determination (and optionally an analysis) of a shot type returned by the user as discussed in detail below. For example, the automatic ball machine 100 may adjust, for an individual shot type, parameters that include, but are not limited to velocity, magnitude of spin, orientation of spin, height, launch angle, location (e.g., landing point on the court), slice, height, trajectory, etc.

A sixth workout routine may focus on, for example, the overall gameplay of a user or game strategy. Accordingly, the shot sequence in the sixth workout routine may include a variety of shot types (e.g., serve, drive, lob, drop shot, volley, etc.). In the sixth workout routine, the automatic ball machine 100 may not only vary the parameters of the shots from one shot type to another shot type, but the automatic ball machine 100 may also vary the parameters of individual shots in each shot type included in the sequence of shots. For example, in a sixth workout routine that includes a non-limiting example of three serves, three drives, and three lobs: the automatic ball machine 100 may vary the parameters such that a first set of parameters corresponding to the three serves, a second set of parameters corresponding to the three drives, and a third set of parameters corresponding to the three lobs are different from each other (i.e., the first, second, and third set of parameters are not the same). Additionally, in the sixth workout routine that includes the non-limiting example of three serves, three drives, and three lobs: the automatic ball machine 100 may vary the parameters of one or more of the three serves; the automatic ball machine 100 may vary parameters of one or more of the three drives; and the automatic ball machine 100 may vary the parameters of one or more of the three lobs.

Each of the first through sixth workout routines described above may be referred to as a "responsive workout routine." A responsive workout routine includes a sequence of shots in which the automatic ball machine 100 varies the types of shots included in the sequence of shots based on a determination (and optionally an analysis) of a shot type returned by the user and/or adjusts the parameters of one or more of the shots included in the sequence of shots based on the determination (and optionally the analysis) of the shot type returned by the user.

Ordinal numbers such as "first," "second," "third," etc. may be used simply as labels of certain elements, steps, etc., to distinguish such elements, steps, etc. from one another. Terms that are not described using "first," "second," etc., in the specification, may still be referred to as "first" or "second" in a claim. In addition, a term that is referenced with a particular ordinal number (e.g., "first" in a particular claim) may be described elsewhere with a different ordinal number (e.g., "second" in the specification or another claim). Additionally, the number and variety of the types of workout routines described herein are non-limiting. Each type of workout routine may include sub-types that may vary based on pre-set difficulty levels. For example, with the first workout routine discussed above, the ball machine 100 may launch balls with a given set of parameters based on a pre-set difficulty level. A comparison of a given set of parameters with respect to the pre-set difficulty level may reflect, for example, an increase in velocity, magnitude of spin, etc., in conjunction with an increase in the pre-set difficulty levels.

Subsequent to the initiation of the workout routine, the automatic ball machine 100 may select the shot type of a first shot in the sequence of shots associated with the selected workout routine (S720). For example, when the first workout routine discussed above is selected, the first shot launched by the automatic ball machine 100 is a serve. Similarly, when the second workout routine is selected, the first shot launched by the automatic ball machine 100 is a drive (e.g., directed to the forehand or backhand of the user); when the third workout routine is selected, the first shot launched by the automatic ball machine 100 is a lob; when the fourth workout routine is selected, the first shot launched by the automatic ball machine 100 is a drop shot; and when the fifth workout routine is selected, the first shot launched by the automatic ball machine 100 is a volley. When the sixth workout routine is selected, the first shot launched by the automatic ball machine 100 may be selected from one of a plurality of shot types (e.g., a serve, drive, lob, drop shot, volley, etc.) With respect to the sixth workout routine, the automatic ball machine 100 may randomly select the shot type of the first shot. Alternatively, with respect to the sixth workout routine, the automatic ball machine 100 may select the shot type of the first shot based on the results of the localization procedure detailed in the '345 application and the results of the person detection, person identification, person tracking, and pose estimation procedures detailed in the '167 application. In one embodiment, the automatic ball machine 100 may select the shot type of the first shot based on one or more of the position of the automatic ball machine 100 on the court and the position of the user on the court. For example, when the automatic ball machine 100 and the user are positioned cross court from each other on opposite sides of a center line, the automatic ball machine 100 may select a serve as the first shot type. In another example, when the user is positioned close to the net, the automatic ball machine 100 may select a lob as the first shot type.

In addition to shot type selection, the automatic ball machine 100 may dynamically adjust and set parameters of each shot type in the sequence of shots, such as velocity, magnitude of spin, orientation of spin, height, launch angle, location (e.g., landing point on the court), slice, height, trajectory, etc., based on the results of the localization procedure detailed in the '345 application and the results of the person detection, person identification, person tracking, and pose estimation procedures detailed in the '167 application (S730). Accordingly, the automatic ball machine 100 may launch the first shot in the sequence of shots based on the set parameters. The automatic ball machine 100 may launch the first shot in the sequence of shots based on the set parameters by individually adjusting one or more settings of the ball launching system 130 and/or the height actuator 145. For example, the controller 110 may individually adjust one or more of a speed, tilt, roll, yaw, and height of the ball launching system 130 in order to launch the first shot based on the set parameters. The automatic ball machine 100 may adjust the speed of the ball launching system 130 by adjusting the speed of the spinner wheels 132*a*, 132*b*, 132*c*. The automatic ball machine 100 may individually adjust the speed of one or more of the spinner wheels 132*a*, 132*b*, 132*c* in order to generate different spins on balls launched by the ball launching system 130. The automatic ball machine 100 may adjust the tilt, roll, and yaw of the ball launching system 130 by adjusting the rotational position of the ball launching system 130 with respect to coordinate axes defining a three-dimensional space. The automatic ball machine 100 may adjust the height of the ball launching system 130 by adjusting the height actuator 145.

The person detection, person identification, person tracking, and pose detection procedures detailed in the '167 application may be continuously performed by the automatic ball machine 100 during the workout routine. For example, subsequent to the automatic ball machine 100 launching the first shot to the user, the automatic ball machine 100 may continuously detect a user, identify the user, track the location of the user on the court, and detect a pose of the user. Pose detection may comprise identification of physical locations (i.e., "key points") on the human (i.e., user) body, including hands, feet, joints, head, etc. Together, these key points determine the "pose" of the user (how their body and limbs are oriented) at a moment in time. The pose detection may be modeled as a kinematic model, a planar model, or a volumetric model, for example.

The automatic ball machine 100 may determine the pose of a user in real-time during a workout routine. For example, the automatic ball machine 100 may determine the pose of a user in real-time such that the movement of the key points of the user during a time period in which the user hits a ball (e.g., during a swing motion) may be determined. During the swing motion and in a time period directly before and after the swing motion, the movement, velocity, and position of the user with respect to the court, the movement of the key points of the user, and the position and orientation of the user's racket (i.e., the racket held by the user) may be referred to herein as "stroke data." The time period directly before the swing motion and the time period directly after the swing motion may be the same duration or may be different durations. For example, the time period directly before the swing motion and the time period directly after the swing motion may have a value selected from a range between 0.2 and 2 seconds.

Additionally, using the imaging system 120, the automatic ball machine 100 may track the return flight of the ball 101 hit by the user to determine position, velocity, and acceleration of the ball with respect to the court during flight as well as the landing point of the ball 101 on the court. The tracked return flight of the ball 101 may also include the position, velocity, and acceleration of the ball 101 with respect to the court subsequent to the landing point of the ball 101 on the court. The tracked return flight of the ball 101 hit by the user may be referred to herein as "return ball flight data." In some embodiments in which the imaging system 120 is unable to determine the landing point of the ball 101 on the court, the automatic ball machine 100 may model the return flight of the ball 101 using a physical model of the ball 101, environmental conditions (e.g., air temperature, air pressure, etc.), and the known geography of the court as detailed in the '345 application to determine the landing point of the ball 101 on the court. Accordingly, in such an embodiment, the automatic ball machine 100 may capture the return ball flight data using the imaging system 120 in combination with the physical model. The physical model of the ball may include parameters, such as friction coefficients, density, weight, coefficient of drag, material, wear, etc., corresponding to the ball 101. The automatic ball machine 100 may also utilize a physical model of the court in determining the position, velocity, and acceleration of the ball 101 with respect to the court subsequent to the landing point of the ball 101 on the court. The physical model of the court may include parameters, such as the physical characteristics of the court (e.g., a friction coefficient, elasticity, and hardness of the playing surface, a friction coefficient, elasticity, and hardness of an enclosure surrounding the playing surface, etc.).

The automatic ball machine 100 may use the return ball flight data and the stroke data to determine a type of shot (i.e., shot type) hit (i.e., returned) by the user (S740). For example, the automatic ball machine 100 may use the return ball flight data and the stroke data to determine that the shot type hit by the user is one of a drive (e.g., an overhead drive, a forehand drive, a backhand drive), a volley (e.g., a forehand volley, a backhand volley, a forehand half-volley, a backhand-half volley), a lob (e.g., a forehand lob and a backhand lob), a drop shot (e.g., a forehand drop shot and a backhand drop shot), etc. The automatic ball machine 100 may also use the return ball flight data and the stroke data to determine the spin (e.g., topspin, backspin) of the shot type hit by the user. In some embodiments, to determine the shot type hit by the user, the automatic ball machine 100 may analyze the stroke data captured using the pose detection procedure (i.e., "captured stroke data") and the return ball flight data to determine whether the captured stroke data and the return ball flight data matches previously stored stroke data (i.e., "stored stroke data" and previously stored ball flight data (i.e., "stored ball flight data") corresponding to a shot type. For example, the automatic ball machine 100 may store a plurality of shot types in memory in association with stored stroke data and stored ball flight data corresponding to each of the plurality of shot types. The stored stroke data and stored ball flight data may be generated using machine-learning by labeling stored video and training a learning algorithm. The stored video utilized in the machine-learning may include sets of videos that are specific to different types of racket sports. For example, each set of videos may correspond to an individual racket sport, such as tennis, platform tennis court, padel, pickleball, POP tennis, etc. Accordingly, the generated stored stroke data and stored ball flight data may be racket sport specific.

When the automatic ball machine 100 captures, in relation to a swing motion of a user during a workout routine, stroke data of the user and return ball flight data, the automatic ball machine 100 may compare the captured stroke data to stored stroke data stored in memory, and compare the captured return ball flight data to stored ball flight data stored in memory. For example, when the captured return ball flight data matches stored ball flight data, the automatic ball machine 100 may identify the shot type hit by the user as the shot type stored in memory that corresponds to the matched return ball flight data. In another example, when the captured stroke data matches stored stroke data, the automatic ball machine 100 may identify the shot type hit by the user as the shot type stored in memory that corresponds to the matched stored stroke data. A comparison "match" may be based on a mathematical measure of similarity or closeness. Non-limiting examples of a mathematical measure of similarity or closeness utilized by the automatic ball machine 100 may include Sum of Squared Distances (SSD), Intersection over Union, cosine similarity, etc.

As discussed above, the stored stroke data and the stored ball flight data may be racket sport specific to thereby accurately characterize shot types in accordance with the rules of play governing different racket sports. Certain parameters that may define how a shot type, such as "serve" is hit, may vary across different racket sports and are defined by the rules of play adopted by the governing bodies of the respective racket sports. For example, the International Tennis Federation (e.g., 2022 ITF Rules of Tennis) sets forth the rules of play for tennis, the American Platform Tennis Association (e.g., Official Rules of Platform Tennis) sets forth the rules of play for platform tennis, the International Padel Federation (e.g., Regulations of the Padel Game) sets forth the rules of play for padel, the International Federation of Pickleball (e.g., 2022 Official IFP Rulebook) sets forth the rules of play for pickleball, and the International POP tennis Association (e.g., Court and Equipment Guide) sets forth the rules of play for POP tennis.

As detailed in the '345 application, the automatic ball machine 100 may include settings to indicate, for example, one of a tennis court, a platform tennis court, a padel court, a pickleball court, a POP tennis court, etc. When the settings of the automatic ball machine 100 are adjusted to indicate a specific court, the automatic ball machine 100 may utilize stored stroke data and stored ball flight data corresponding to that specific racket sport when executing the comparison of captured stroke data and return ball flight data. For example, when settings of the automatic ball machine 100 indicate a tennis court, the automatic ball machine 100 may utilize stored stroke data and stored ball flight data corresponding to tennis.

The comparison of the captured stroke data to stroke data stored in memory, and the comparison of the captured return ball flight data to ball flight data stored in memory may be used separately or in conjunction to identify the shot type hit by the user. For example, the automatic ball machine 100 may perform a first comparison of the captured return ball flight data to stored ball flight data stored in memory to identify a first category of shot type hit by the user. The first category of shot type may include, for example, a drive, a volley, a lob, a drop shot, etc. The automatic ball machine may also perform a second comparison of the captured stroke data to stroke data stored in memory to identify a second category of shot type hit by the user. The second category of shot type may include, for example, an overhead drive, a forehand drive, a backhand drive, a forehand volley, a backhand volley, a forehand half-volley, a backhand-half volley, a forehand lob, a backhand lob, a forehand drop shot, a backhand drop shot, etc. Accordingly, when the first comparison and the second comparison are used in conjunction, the automatic ball machine 100 may utilize the second comparison to further identify the shot type hit by the user. For example, when the first comparison identifies the shot type hit by the user as a drive, the automatic ball machine 100 may utilize the second comparison to further identify the shot type hit by the user as one of an overhead drive, a forehand drive, and a backhand drive. In another example, when the first comparison identifies the shot type hit by the user as a volley, the automatic ball machine 100 may utilize the second comparison to further identify the shot type hit by the user as one of a forehand volley, a backhand volley, a forehand half-volley, and a backhand-half volley. Similarly, when the first comparison identifies the shot type hit by the user as a lob, the automatic ball machine 100 may utilize the second comparison to further identify the shot type hit by the user as one of a forehand lob and a backhand lob; and when the first comparison identifies the shot type hit by the user as a drop shot, the automatic ball machine 100 may utilize the second comparison to further identify the shot type hit by the user as one of a forehand drop shot and a backhand drop shot. The automatic ball machine 100 may also utilize the second comparison to confirm the accuracy of the shot type identified using the first comparison.

In yet another example, the automatic ball machine 100 may perform a first comparison of the captured stroke data to stroke data stored in memory to identify a first category of shot type hit by the user. The first category of shot type may include, for example, a forehand, a backhand, an overhead, etc. The automatic ball machine may also perform a second comparison of the captured return ball flight data to ball flight data stored in memory to identify a second category of shot type hit by the user. The second category of shot type may include, for example, a forehand drive, a forehand volley, a forehand half-volley, a forehand lob, a forehand drop shot, a backhand drive, a backhand volley, a backhand-half volley, a backhand lob, a backhand drop shot, an overhead drive (e.g., smash), etc. Accordingly, as discussed above, when the first comparison and the second comparison are used in conjunction, the automatic ball machine 100 may utilize the second comparison to further identify the shot type hit by the user. For example, when the first comparison identifies the shot type hit by the user as a forehand, the automatic ball machine 100 may utilize the second comparison to further identify the shot type hit by the user as one of a forehand drive, a forehand volley, a forehand half-volley, a forehand lob, and a forehand drop shot. In another example, when the first comparison identifies the shot type hit by the user as a backhand, the automatic ball machine 100 may utilize the second comparison to further identify the shot type hit by the user as one of a backhand drive, a backhand volley, a backhand-half volley, a backhand lob, and a backhand drop shot. Similarly, when the first comparison identifies the shot type hit by the user as overhand, the automatic ball machine 100 may utilize the second comparison to further identify the shot type hit by the user as one of an overhand drive and smash. The automatic ball machine 100 may also utilize the second comparison to confirm the accuracy of the shot type identified using the first comparison.

Based on the identified shot type hit by the user, the automatic ball machine 100 may dynamically select a second (i.e., subsequent) shot type to launch to the user in response (S750). Additionally, parameters of the selected second shot type may be adjusted and set based on the stroke data of the user and the return ball flight data corresponding to the swing motion of the shot type hit by the user. The parameters of the selected second shot type may include, for example, velocity, magnitude of spin, orientation of spin, height, launch angle, location (e.g., landing point on the court), slice, height, trajectory, etc. Additionally, the parameters may also include a time interval from a time at which the shot hit by the user lands on the court and time at which the automatic ball machine 100 launches a shot in response. The time interval from the time at which the shot hit by the user lands on the court and time at which the automatic ball machine 100 launches a shot in response, may be referred to herein as a "launch interval." Moreover, the selected second shot type may also be based on the type of workout routine that is being executed, wherein the type of workout routine may also include a pre-set difficulty level, as discussed above, corresponding to the workout routine. For example, when the workout routine is the first workout routine discussed above, the shot type selected by the automatic ball machine to launch as the second shot in the sequence to a user is a serve, as the first workout routine is focused on the service return of a user. Similarly, the shot type selected for the second shot in the sequence with respect to the second workout routine is a drive; the shot type selected for the second shot in the sequence with respect to the third workout routine is a lob, the shot type selected for the second shot in the sequence with respect to the fourth workout routine is a drop shot; and the shot type selected for the second shot in the sequence with respect to the fifth workout routine is a volley. With respect to the sixth workout routine, the shot type selected for the second shot in the sequence may be selected from a variety of shot types (e.g., serve, drive, lob, drop shot, volley, etc.)

The automatic ball machine 100 may dynamically adjust and set the parameters (e.g., velocity, magnitude of spin, orientation of spin, height, launch angle, location (e.g., landing point on the court), slice, height, trajectory, launch interval, etc.) of the selected second shot type (e.g., serve in the example of the first workout routine) to launch to the user based on the stroke data of the user and the return ball flight data corresponding to the swing motion of the shot type hit by the user in response to the first shot launched in the sequence by the automatic ball machine 100. For example, the automatic ball machine 100 may reduce, one or more of the velocity, magnitude of spin, slice, etc. of the selected second shot type, when the shot type hit by the user does not achieve one or more predetermined requirements (e.g., landing in a predetermined area of the court, proximity to a line marking on the court, attaining a predetermined velocity during flight, crossing the net at a predetermined height, etc.). The predetermined area of the court may be, for example, within the playing area of the court or, more narrowly, within a delineated region of the playing area. The reduction of one or more of the velocity, magnitude of spin, slice of the balls, etc. may reduce the difficulty of the selected second shot type launched by the automatic ball machine 100 such that the subsequent shot type hit (i.e., returned) by the user in response to the second shot launched in the sequence by the automatic ball machine 100 may be more likely to achieve the one or more predetermined requirements. In another example, the automatic ball machine 100 may increase, for example, one or more of the velocity, magnitude of spin, slice, etc. of the selected second shot type when the shot type hit by the user does achieve the one or more predetermined requirements. The increase of one or more of the velocity, magnitude of spin, slice, etc. of the selected second shot type may increase the difficulty of the selected second shot type launched by the automatic ball machine 100 such that the subsequent shot type hit (i.e., returned) by the user in response to the second shot launched in the sequence by the automatic ball machine 100 will be less likely to achieve the one or more predetermined requirements.

With respect specifically, to the stroke data, the automatic ball machine 100 may dynamically adjust and set the parameters of the selected second shot type to launch to the user based on the movement velocity and position of the user with respect to the court. For example, the automatic ball machine 100 may dynamically adjust and set the parameters of the selected second shot type such that the landing point is at a predetermined distance or more from the position of the user. The predetermined distance may be determined, for example, so as to maximize or minimize the overall distance traversed by the user during the workout routine, maximize or minimize the lateral distance traversed by the user during the workout routine, maximize or minimize the overall medial distance traversed by the user during the workout routine, and/or mimic a game play strategy during the workout routine.

The automatic ball machine 100 may continue to dynamically select shot types, adjust parameters of the selected shot types, and launch the parameter adjusted selected shot types to the user until the end of the workout routine (S760). As discussed above, the end of a workout routine may be defined by limiting the number of shots in the sequence or by a predetermined time interval. Additionally, the end of a workout routine may be defined by a pre-set user related metric. For example, the pre-set user related metric may correspond to the number or percentage of return shots hit by the user achieving one or more predetermined requirements (e.g., landing in a predetermined area of the court, proximity to an area of the court (e.g., net, line marking, enclosure, etc.) during flight, attaining a predetermined velocity during flight, crossing the net at a predetermined height, etc.). When the end of the workout routine is defined by limiting the number of shots in the sequence, the automatic ball machine 100 may maintain a count of the number of balls launched during the workout routine and compare the count to the predetermined number of shots that defines the end of the workout routine. When the count does not equal the predetermined number of shots (NO), step S750 for the subsequent shot in the sequence is repeated. When the count is equal to the predetermined number of shots (YES), the workout routine ends. In another embodiment in which the end of the workout routine is defined by a predetermined time interval, the automatic ball machine 100 may maintain a timer that measures the duration of time from the initiation of the workout routine in step S710 and compare the measured duration of time to the predetermined time interval that defines the end of the workout routine. When the measured duration of time does not equal the predetermined time interval (NO), step S750 for the subsequent shot in the sequence is repeated. When the measured duration of time is equal to the predetermined time interval (YES), the workout routine ends. In yet another embodiment in which the end of the workout routine is defined by a pre-set user related metric, the automatic ball machine 100 may maintain a count or percentage of return shots hit by the user that achieve the one or more predetermined requirements and compare the count or percentage to a predetermined number or percentage that defines the end of the workout routine. When the count or percentage does not equal the predetermined number or percentage that defines the end of the workout routine (NO), step S750 for the subsequent shot in the sequence is repeated. When the count or percentage is equal to the predetermined number or percentage that defines the end of the workout routine (YES), the workout routine ends.

Within the workout routine, in addition to determining the type of shot type hit by the user as discussed with respect to S740 above, the automatic ball machine 100 may grade each shot hit (i.e., returned) by the user. The automatic ball machine 100 may utilize the grade to assign a skill level rating to the user that is based on the workout routine. For example, the grade may be a numeric value that can be compared to a predetermined scale or classification table that correlates the numeric value or a range of the numeric value to a skill rating classification. Non-limiting examples of skill ratings may include, "beginner," "intermediate," and "advanced." The automatic ball machine 100 may output one or both of the numeric value or the skill rating to the user and the end of the workout routine.

The automatic ball machine 100 may also dynamically adjust the parameter of launch interval based on the velocity and/or angle at which the shot type hit by the user lands on the court. For example, as the velocity increases and/or the angle decreases, the automatic ball machine 100 may decrease the launch interval. In another example, as the velocity decreases and/or the angle increases, the automatic ball machine 100 may increase the launch interval. In racket sports, such as platform tennis and padel in which the ball 101 may be played off an enclosure surrounding the playing surface, the automatic ball machine 100 may further adjust the launch interval to include a time delay that corresponds to the ball 101 being played off the enclosure.

The automatic ball machine 100 disclosed herein may dynamically adjust and set the parameters of the balls launched, launch interval, and shot types launched to the user based on the performance of the user (measured using the stroke data and the return ball flight data) during a workout routine when compared to one or more predetermined requirements. Accordingly, the automatic ball machine 100 may execute a dynamic and responsive workout routine to a user based on the performance of the user during the workout routine.

For ease of explanation, the above descriptions of the shot identification and analysis procedure have been described with respect to a single user. However, aspects of the disclosure are not limited to a single user. As detailed in the '167 application, the automatic ball machine 100 may perform the procedures of person detection, person identification, person tracking, and pose estimation with respect to multiple users over a single workout routine. Accordingly, aspects of the shot identification and analysis procedure disclosed herein may be performed with respect to multiple users over a single workout routine. For example, within a single workout routine, the automatic ball machine 100 may dynamically select shot types, adjust parameters of the selected shot types, and launch the adjusted selected shot types based on the detection and identification of a specific user from among a plurality of users.

Figure 8:
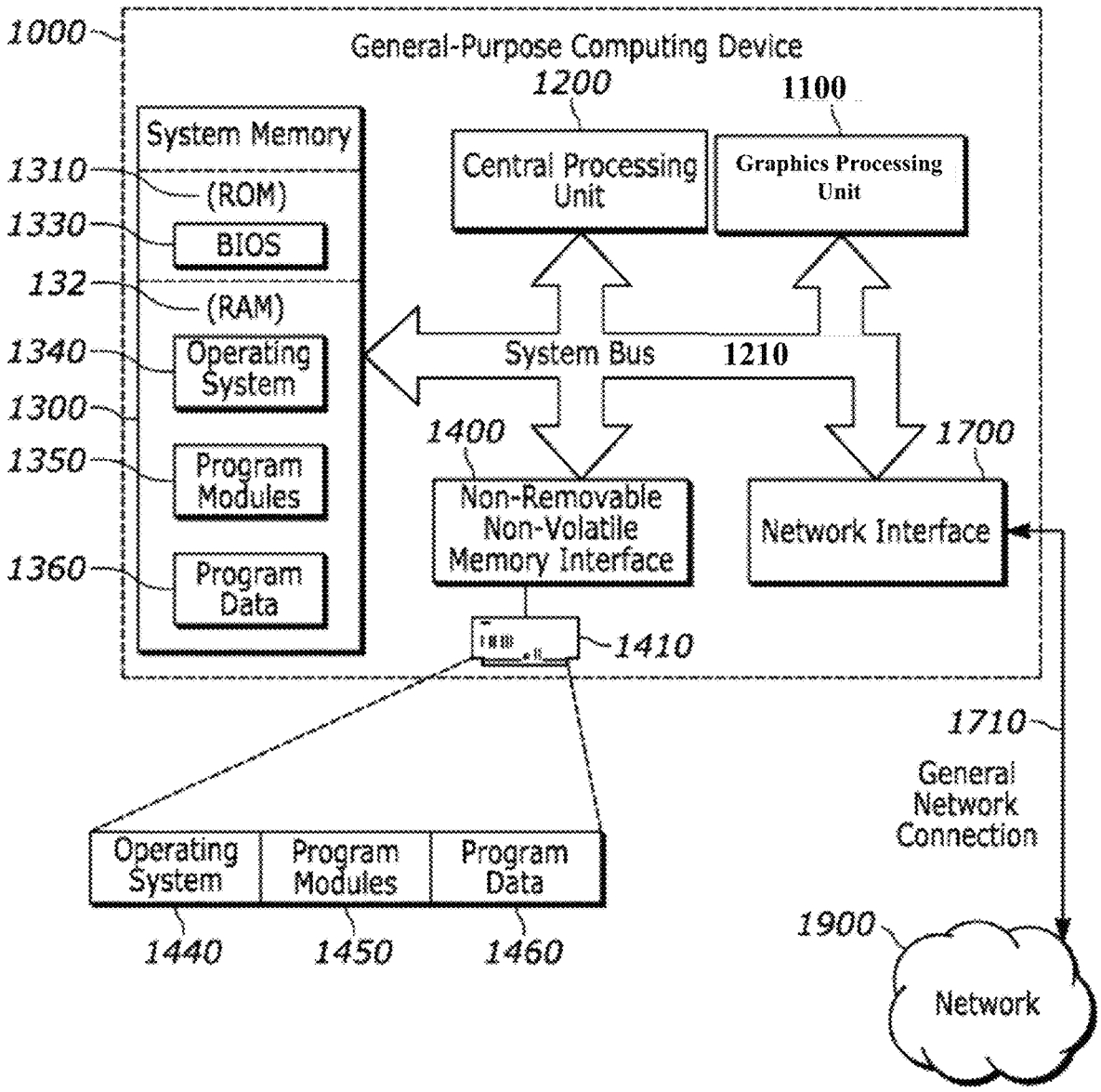
FIG. 8 illustrates an example general-purpose computing device for use with the automatic ball according to example embodiments.

With reference to FIG. 8, an exemplary general-purpose computing device is illustrated in the form of the exemplary general-purpose computing device 1000. The general-purpose computing device 1000 may be of the type utilized for the controller 110 (FIGS. 1-6) as well as the other computing devices with which the controller 110 may communicate through a communication network 1900. As such, it will be described with the understanding that variations may be made thereto. The exemplary general-purpose computing device 1000 may include, but is not limited to, one or more graphics processing units (GPUs) 1100, one or more central processing units (CPUs) 1200, a system memory 1300, such as including a Read Only Memory (ROM) 1310 to store a Basic Input/Output System (BIOS) 1330 and a Random Access Memory (RAM) 1320, and a system bus 1210 that couples various system components including the system memory to the CPU(s) 1200. The system bus 1210 may be any of several types of bus structures including a memory bus or memory controller, a peripheral bus, and a local bus using any of a variety of bus architectures. Depending on the specific physical implementation, one or more of the GPUs 1100, CPUs 1200, the system memory 1300 and other components of the general-purpose computing device 1000 may be physically co-located, such as on a single chip. In such a case, some or all of the system bus 1210 may be communicational pathways within a single chip structure.

The general-purpose computing device 1000 also typically includes computer readable media, which may include any available media that may be accessed by the general-purpose computing device 1000. By way of example, and not limitation, computer readable media may comprise computer storage media and communication media. Computer storage media includes media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by the general-purpose computing device 1000. Communication media typically embodies computer readable instructions, data structures, program modules or other data in a modulated data signal such as a carrier wave or other transport mechanism and includes any information delivery media. By way of example, and not limitation, communication media includes wired media such as a wired network or direct-wired connection, and wireless media such as acoustic, RF, infrared and other wireless media. Combinations of any of the above should also be included within the scope of computer readable media.

When using communication media, the general-purpose computing device 1000 may operate in a networked environment via logical connections to one or more remote computers. The logical connection depicted in FIG. 8 is a general network connection 1710 to the network 1900, which may be a local area network (LAN), a wide area network (WAN) such as the Internet, or other networks. The computing device 1000 is connected to the general network connection 1710 through a network interface or adapter 1700 that is, in turn, connected to the system bus 1210. In a networked environment, program modules depicted relative to the general-purpose computing device 1000, or portions or peripherals thereof, may be stored in the memory of one or more other computing devices that are communicatively coupled to the general-purpose computing device 1000 through the general network connection 1710. It will be appreciated that the network connections shown are exemplary and other means of establishing a communications link between computing devices may be used.

The general-purpose computing device 1000 may also include other removable/non-removable, volatile/nonvolatile computer storage media. By way of example only, FIG. 8 illustrates a hard disk drive 1410 that reads from or writes to non-removable, nonvolatile media. Other removable/non-removable, volatile/nonvolatile computer storage media that may be used with the exemplary computing device include, but are not limited to, magnetic tape cassettes, flash memory cards, digital versatile disks, digital video tape, solid state RAM, solid state ROM, and the like. The hard disk drive 1410 is typically connected to the system bus 1210 through a non-removable memory interface such as interface 1400.

The drives and their associated computer storage media discussed above and illustrated in FIG. 8, provide storage of computer readable instructions, data structures, program modules and other data for the general-purpose computing device 1000. In FIG. 8, for example, hard disk drive 1410 is illustrated as storing operating system 1440, other program modules 1450, and program data 1460. Note that these components may either be the same as or different from operating system 1340, other program modules 1350 and program data 1360, stored in RAM 1320. Operating system 1440, other program modules 1450 and program data 1460 are given different numbers here to illustrate that, at a minimum, they are different copies.

With reference to FIGS. 1-6, again, the foregoing description applies to the controller 110, as well as to any other computing devices in communication with the controller 110 through the network 1900. The network interface 1700 facilitates outside communication in the form of voice and/or data. For example, the network interface 1700 may include a connection to a Plain Old Telephone Service (POTS) line, or a Voice-over-Internet Protocol (VOIP) line for voice communication. In addition, the network interface 1700 may be configured to couple into an existing network, through wireless protocols (Bluetooth, 802.11a, ac, b, g, n, or the like) or through wired (Ethernet, or the like) connections, or through other more generic network connections. In still other configurations, a cellular link may be provided for both voice and data (i.e., GSM, CDMA or other, utilizing 2G, 3G, 4G, and/or 5G data structures and the like). The network interface 1700 is not limited to any particular protocol or type of communication. It is, however, preferred that the network interface 1700 be configured to transmit data bi-directionally, through at least one mode of communication. The more robust the structure of communication, the more manners in which to avoid a failure or a sabotage with respect to communication, such as to collect healthcare information in a timely manner.

The program modules 1350 comprises a user interface which may configure the automatic ball machine 100. In many instances, the program modules 1350 comprise a keypad with a display that is connected through a wired/wireless connection with the controller 110. With the different communication protocols associated with the network interface 1700, the program modules 1350 may comprise a wireless device that communicates with the CPUs 1200 through a wireless communication protocol (i.e., Bluetooth, RF, WIFI, etc.). In other configurations, the program modules 1350 may comprise a virtual programming module in the form of software that is on, for example, a smartphone, in communication with the network interface 1700. In still other configurations, such a virtual programming module may be located in the cloud (or web based), with access thereto through any number of different computing devices. Advantageously, with such a configuration, the player may communicate with the automatic ball machine 100 remotely, with the ability to change functionality.

The foregoing is illustrative of example embodiments and is not to be construed as limiting thereof. Although some example embodiments have been described, those skilled in the art will readily appreciate that many modifications are possible in the example embodiments without materially departing from the novel teachings and advantages of the example embodiments. Accordingly, all such modifications are intended to be included within the scope of the example embodiments as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A ball machine comprising:

an imaging system attached to the ball machine and configured to capture image data of a court;

a ball launching system configured to launch a ball to a user;

a memory configured to store, as stored stroke data, data in association with each of a plurality of shot types including a serve, drive, lob, and drop shot; and a processor configured to execute a process that includes initiating a workout routine that includes launching, using the ball launching system, a sequence of balls to a user, selecting a shot type of a first ball to launch in the sequence, the selected shot type of the first ball being one of a serve, drive, lob, and drop shot, controlling settings of the ball launching system to launch the first ball based on the selected shot type to the user, capturing, using the imaging system, as captured stroke data, data that corresponds to the user during a time period that includes a moment in time when the user returns the first ball, determining a shot type returned by the user in response to the launched first ball, the returned shot type being one of a drive, lob, and drop shot, selecting a shot type of a second ball to launch in the sequence based on the determined shot type returned by the user in response to the launched first ball, the selected shot type of the second ball being one of a drive, lob, and drop shot, and controlling settings of the ball launching system to adjust one or more parameters of the second ball based on the determined shot type returned by the user in response to the launched first ball, wherein the selected shot type of the first ball is different from the selected shot type of the second ball, and wherein the stroke data includes a pose of the user and movement, velocity, and position of the user with respect to the court, wherein determining the shot type returned by the user in response to the launched first ball includes comparing the captured stroke data to stored stroke data, and when the captured stroke data matches stored stroke data, identifying the shot type returned by the user as a shot type associated with the matched stored stroke data.

2. The ball machine of claim 1, wherein the selected shot type of the first ball and the selected shot type of the second ball are further selected based on one or more of the position of the ball machine on the court and the position of the user on the court.

3. The ball machine of claim 1, wherein the ball launching system includes three spinner wheels, and wherein the controlling the settings of the ball launching system includes individually adjusting a speed of one or more of the spinner wheels.

4. The ball machine of claim 1, wherein the stroke data further includes the movement of key points of the user, and the position and orientation of a racket held by the user.

5. The ball machine of claim 1, wherein the controlling settings of the ball launching system to adjust one or more parameters of the second ball is further based on one or more of the landing point with respect to the court, proximity to an area of the court during flight, velocity during flight, and height of the shot type returned by the user.

6. The ball machine of claim 1, wherein the parameters of the second ball include velocity, magnitude of spin, orientation of spin, height, launch angle, location, slice, trajectory, and launch interval.

7. A method of operating a ball machine, the method comprising:

storing in memory, as stored stroke data, data in association with each of a plurality of shot types including a serve, drive, lob, and drop shot;

initiating a workout routine that includes launching, using a ball launching system, a sequence of balls to a user positioned on a court;

selecting a shot type of a first ball to launch in the sequence, the selected shot type of the first ball being one of a serve, drive, lob, and drop shot;

controlling settings of the ball launching system to launch the first ball based on the selected shot type to the user;

capturing, using an imaging system, as captured stroke data, data that corresponds to the user during a time period that includes a moment in time when the user returns the first ball;

determining a shot type returned by the user in response to the launched first ball, the returned shot type being one of a drive, lob, and drop shot;

selecting a shot type of a second ball to launch in the sequence based on the determined shot type returned by the user in response to the launched first ball, the selected shot type of the second ball being one of a drive, lob, and drop shot; and controlling settings of the ball launching system to adjust one or more parameters of the second ball based on the determined shot type returned by the user in response to the launched first ball, wherein the selected shot type of the first ball is different from the selected shot type of the second ball, wherein the stroke data includes a pose of the user and movement, velocity, and position of the user with respect to the court, and wherein determining the shot type returned by the user in response to the launched first ball includes comparing the captured stroke data to stored stroke data, and when the captured stroke data matches stored stroke data, identifying the shot type returned by the user as a shot type associated with the matched stored stroke data.

8. The method of claim 7, wherein the selected shot type of the first ball and the selected shot type of the second ball are further selected based on one or more of the position of the ball machine on the court and the position of the user on the court.

9. The method of claim 7, wherein the controlling the settings of the ball launching system includes individually adjusting a speed of one or more spinner wheels included in the ball launching system.

10. The method of claim 7, wherein the controlling the settings of the ball launching system includes adjusting one or more of the tilt, roll, and yaw of the ball launching system.

11. The method of claim 7, wherein the stroke data further includes movement of key points of the user, and the position and orientation of a racket held by the user.

12. The method of claim 7, wherein the controlling settings of the ball launching system to adjust one or more parameters of the second ball is further based on one or more of the landing point with respect to the court, proximity to an area of the court during flight, velocity during flight, and height of the shot type returned by the user.

13. The method of claim 7, wherein the parameters of the second ball include velocity, magnitude of spin, orientation of spin, height, launch angle, location, slice, trajectory, and launch interval.

14. A ball machine comprising:

an imaging system attached to the ball machine and configured to capture image data of a court;

a ball launching system configured to launch a ball to a user;

a memory configured to store, as stored ball flight data, data in association with each of a plurality of shot types including a serve, drive, lob, and drop shot; and a processor configured to execute a process that includes initiating a workout routine that includes launching, using the ball launching system, a sequence of balls to a user, selecting a shot type of a first ball to launch in the sequence, the selected shot type of the first ball being one of a serve, drive, lob, and drop shot, controlling settings of the ball launching system to launch the first ball based on the selected shot type to the user, capturing, using the imaging system, as captured ball flight data, data that corresponds to a return flight of the first ball returned by the user, determining a shot type returned by the user in response to the launched first ball, the returned shot type being one of a drive, lob, and drop shot, selecting a shot type of a second ball to launch in the sequence based on the determined shot type returned by the user in response to the launched first ball, the selected shot type of the second ball being one of a drive, lob, and drop shot, and controlling settings of the ball launching system to adjust one or more parameters of the second ball based on the determined shot type returned by the user in response to the launched first ball, wherein the selected shot type of the first ball is different from the selected shot type of the second ball, and wherein the ball flight data includes position, velocity, and acceleration of the ball with respect to the court during flight of the ball, wherein determining the shot type returned by the user in response to the launched first ball includes comparing the captured return ball flight data to stored return ball flight data, and when the captured return ball flight data matches stored ball flight data, identifying the shot type returned by the user as a shot type associated with the matched stored return ball flight data.

15. The ball machine of claim 14, wherein the selected shot type of the first ball and the selected shot type of the second ball is further selected based on one or more of the position of the ball machine on the court and the position of the user on the court.

16. The ball machine of claim 14, wherein the return ball flight data includes the landing point of the ball on the court.

17. A method of operating a ball machine, the method comprising:

storing in memory, as stored ball flight data, data in association with each of a plurality of shot types including a serve, drive, lob, and drop shot;

initiating a workout routine that includes launching, using a ball launching system, a sequence of balls to a user positioned on a court;

selecting a shot type of a first ball to launch in the sequence, the selected shot type of the first ball being one of a serve, drive, lob, and drop shot;

controlling settings of the ball launching system to launch the first ball based on the selected shot type to the user;

capturing, using an imaging system, as captured ball flight data, data that corresponds to a return flight of the first ball returned by the user;

determining a shot type returned by the user in response to the launched first ball, the returned shot type being one of a drive, lob, and drop shot;

selecting a shot type of a second ball to launch in the sequence based on the determined shot type returned by the user in response to the launched first ball, the selected shot type of the second ball being one of a drive, lob, and drop shot; and controlling settings of the ball launching system to adjust one or more parameters of the second ball based on the determined shot type returned by the user in response to the launched first ball, wherein the selected shot type of the first ball is different from the selected shot type of the second ball, and wherein the ball flight data includes position, velocity, and acceleration of the ball with respect to the court during flight of the ball, wherein determining the shot type returned by the user in response to the launched first ball includes comparing the captured return ball flight data to stored return ball flight data, and when the captured return ball flight data matches stored ball flight data, identifying the shot type returned by the user as a shot type associated with the matched stored return ball flight data.

18. The method of claim 17, wherein the selected shot type of the first ball and the selected shot type of the second ball is further selected based on one or more of the position of the ball machine on the court and the position of the user on the court.

19. The method of claim 17, wherein the return ball flight data includes the landing point of the ball on the court.

20. A ball machine comprising:

an imaging system attached to the ball machine and configured to capture image data of a court;

a ball launching system configured to launch a ball to a user;

a memory configured to store, as stored ball flight data, data in association with each of a plurality of shot types included in a first category of shot types, and store, as stored stroke data, data in association with each of a plurality of shot types included in a second category of shot types; and a processor configured to execute a process that includes initiating a workout routine that includes launching, using the ball launching system, a sequence of balls to a user, selecting a shot type of a first ball to launch in the sequence, the selected shot type of the first ball being one of a serve, drive, lob, and drop shot, controlling settings of the ball launching system to launch the first ball based on the selected shot type to the user, capturing, using the imaging system, as captured stroke data, data that corresponds to the user during a time period that includes a moment in time when the user returns the first ball, capturing, using the imaging system, as captured ball flight data, data that corresponds to a return flight of the first ball returned by the user, determining a shot type returned by the user in response to the launched first ball, selecting a shot type of a second ball to launch in the sequence based on the determined shot type returned by the user in response to the launched first ball, the selected shot type of the second ball being one of a drive, lob, and drop shot, and controlling settings of the ball launching system to adjust one or more parameters of the second ball based on the determined shot type returned by the user in response to the launched first ball, wherein the selected shot type of the first ball is different from the selected shot type of the second ball, and wherein the stroke data includes a pose of the user and movement, velocity, and position of the user with respect to the court, wherein the ball flight data includes position, velocity, and acceleration of the ball with respect to the court during the return flight of the first ball, wherein determining the shot type returned by the user in response to the launched first ball includes performing a first comparison of the captured return ball flight data to stored return ball flight data, performing a second comparison of the captured stroke data to stored stroke data, when the captured return ball flight data matches stored ball flight data, identifying the shot type returned by the user as a first category shot type associated with the matched stored return ball flight data, and when the captured stroke data matches stored stroke data, further identifying the shot type returned by the user as a second category shot type associated with the matched stored stroke data.

21. The ball machine of claim 20, wherein the shot types included in the first category of shot types include a drive, a lob, and a drop shot, and wherein the shot types included in the second category of shot types include an overhead drive, a forehand drive, a backhand drive, a forehand lob, a backhand lob, a forehand drop shot, and a backhand drop shot.

22. The ball machine of claim 20, wherein the selected shot type of the first ball and the selected shot type of the second ball is further selected based on one or more of the position of the ball machine on the court and the position of the user on the court.

23. The ball machine of claim 20, wherein the stroke data further includes the movement of key points of the user, and the position and orientation of a racket held by the user.

24. The ball machine of claim 20, wherein the return ball flight data includes the position, velocity, and acceleration of the ball with respect to the court during flight as well as the landing point of the ball on the court.

25. The ball machine of claim 20, wherein the ball launching system includes three spinner wheels, and wherein the controlling the settings of the ball launching system includes individually adjusting a speed of one or more of the spinner wheels.

26. The ball machine of claim 20, wherein the parameters of the second ball include velocity, magnitude of spin, orientation of spin, height, launch angle, location, slice, trajectory, and launch interval.

27. A method of operating a ball machine, the method comprising:

storing in memory, as stored ball flight data, data in association with each of a plurality of shot types included in a first category of shot types;

storing in memory, as stored stroke data, data in association with each of a plurality of shot types included in a second category of shot types;

initiating a workout routine that includes launching, using a ball launching system, a sequence of balls to a user positioned on a court;

selecting a shot type of a first ball to launch in the sequence, the selected shot type of the first ball being one of a serve, drive, lob, and drop shot;

controlling settings of the ball launching system to launch the first ball based on the selected shot type to the user;

capturing, using an imaging system, as captured stroke data, data that corresponds to the user during a time period that includes a moment in time when the user returns the first ball;

capturing, using the imaging system, as captured ball flight data, data that corresponds to a return flight of the first ball returned by the user;

determining a shot type returned by the user in response to the launched first ball;

selecting a shot type of a second ball to launch in the sequence based on the determined shot type returned by the user in response to the launched first ball, the selected shot type of the second ball being one of a drive, lob, and drop shot; and controlling settings of the ball launching system to adjust one or more parameters of the second ball based on the determined shot type returned by the user in response to the launched first ball, wherein the selected shot type of the first ball is different from the selected shot type of the second ball, and wherein the stroke data includes a pose of the user and movement, velocity, and position of the user with respect to the court, wherein determining the shot type returned by the user in response to the launched first ball includes performing a first comparison of the captured return ball flight data to stored return ball flight data, performing a second comparison of the captured stroke data to stored stroke data, when the captured return ball flight data matches stored ball flight data, identifying the shot type returned by the user as a first category shot type associated with the matched stored return ball flight data, and when the captured stroke data matches stored stroke data, further identifying the shot type returned by the user as a second category shot type associated with the matched stored stroke data.

28. The method of claim 27, wherein the shot types included in the first category of shot types include a drive, a lob, and a drop shot, and wherein the shot types included in the second category of shot types include an overhead drive, a forehand drive, a backhand drive, forehand lob, a backhand lob, a forehand drop shot, and a backhand drop shot.

29. The method of claim 27, wherein the selected shot type of the first ball and the selected shot type of the second ball is further selected based on one or more of the position of the ball machine on the court and the position of the user on the court.

30. The method of claim 27, wherein the stroke data further includes the movement of key points of the user, and the position and orientation of a racket held by the user.

31. The method of claim 27, wherein the return ball flight data includes the position, velocity, and acceleration of the ball with respect to the court during flight as well as the landing point of the ball on the court.

32. The method of claim 27, wherein the parameters of the second ball include velocity, magnitude of spin, orientation of spin, height, launch angle, location, slice, trajectory, and launch interval.

* * * * *